United States Patent [19]

Moffitt et al.

[11] Patent Number: 4,682,693

[45] Date of Patent: Jul. 28, 1987

[54] PACKAGING TRAY HAVING FLEXIBLE ZONES IN A SUPPORTING LAYER

[76] Inventors: Michael S. Moffitt, 1874 S. 900, East Bountiful, Utah 84010; Brian L. Roberts, 4616 Lanark Rd., Salt Lake City, Utah 84124

[21] Appl. No.: 825,914

[22] Filed: Feb. 4, 1986

[30] Foreign Application Priority Data

Feb. 5, 1985 [NZ] New Zealand ..... 211041

[51] Int. Cl.[4] ..... B65D 85/34

[52] U.S. Cl. ..... 206/583; 206/594; 217/27; 229/2.5 EC

[58] Field of Search ..... 206/521, 523, 583, 587, 206/588–594; 217/26.5, 27; 229/2.5 EC

[56] References Cited

U.S. PATENT DOCUMENTS 2,608,339 8/1952 Benzon-Petersen ..... 229/29 M 3,040,968 6/1962 Long et al. ..... 229/87 F 3,550,842 12/1970 Scholz ..... 229/87 F

FOREIGN PATENT DOCUMENTS 1031847 6/1953 France ..... 217/52

0562446 5/1957 Italy ..... 217/26.5

7312831 3/1975 Netherlands ..... 206/583

*Primary Examiner*—Stephen Marcus

*Assistant Examiner*—Jimmy G. Foster

*Attorney, Agent, or Firm*—Young & Thompson

[57] ABSTRACT

A packaging tray capable of individually and separately supporting a layer of fruit for transport and point of sale display has a plurality of flexible hammock-like recesses formed in a supporting layer. This supporting layer is held above the base of a carton by supports associated with each "hammock-like recess". The flexible recesses allow fruit of varying sizes or shapes to be accommodated within a single layer.

6 Claims, 5 Drawing Figures

PACKAGING TRAY HAVING FLEXIBLE ZONES IN A SUPPORTING LAYER

BACKGROUND

This invention relates to a packaging tray, and has particular application to the packaging of fruit for transport and/or display. Fruit, and in particular kiwifruit, has been packaged in moulded recesses vacuum formed in PVC sheet, with each recess corresponding to the average shape of the fruit to be packed within the tray. These vacuum formed PVC sheets are referred to as pocket packs, and are placed within a supporting outer carton or tray formed out of wood, cardboard or other material.

Existing pocket packs are not satisfactory as fruit can vary in size and shape, from season to season, and from orchard to orchard, thus making it difficult to pack a variety of fruit into a pocket pack having recesses of predetermined size and shape.

There is a need for an improved packaging system enabling variations in fruit size or shape within a size range or count to be accommodated without the fruit appearing too loose within the recesses or without the fruit being damaged by being too large for the recesses.

It is an object of this invention to provide an improved packaging tray which will go some way towards meeting the above mentioned need, or which will at least provide the public with a useful choice.

SUMMARY OF THE INVENTION

In one aspect, the invention provides a packaging tray capable of supporting fruit within recesses, wherein the recesses are created by flexible zones within a supporting layer, which supporting layer is in use spaced apart from a base of a carton by supporting means, so that fruit placed on the supporting layer will result in the flexible zones adapting to the shaped of the fruit.

The fruit supporting recesses, can be created by a series of apertures (preferably slits) in a flexible portion of the supporting layer so that the placement of fruit on top of the material separated by the apertures results in the formation of a hammock-like recess corresponding to the shape of the fruit.

Preferably, the packaging tray is in the form of a "pocket pack" or insert which can be positioned within a carton or substantially rigid tray.

Preferably, the packaging tray has associated supporting means capable of supporting the packaging tray above the base of a carton so that fruit can rest in the hammock-like recesses without touching the base of the carton.

DRAWINGS

These and other aspects of the invention, which should be considered in all its novel aspects, will become apparent from the following description, which is given by way of example only, with reference to the accompanying drawings in which.

PREFERRED EMBODIMENT

Figure 2:
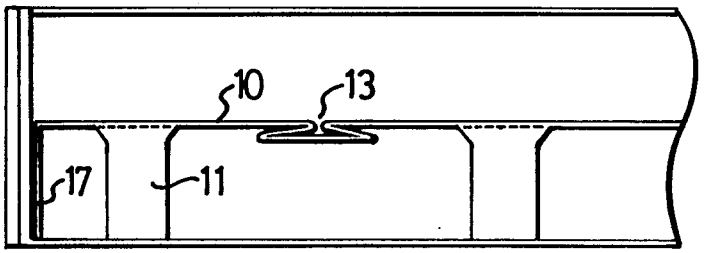
FIG. 2 illustrates the tray of FIG. 1 in side elevation viewed along arrow A.
Figure 3:
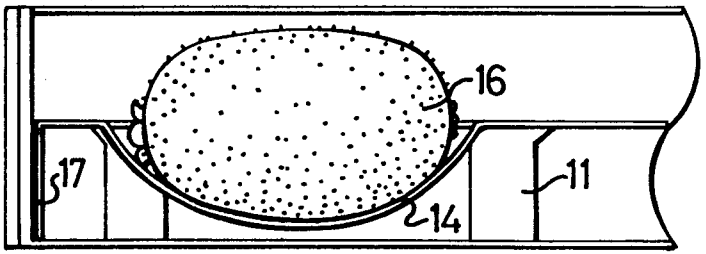
FIG. 3 illustrates a side view of a kiwifruit positioned in the tray of FIG. 1, with a portion of the "hammock" cut-away to show a fruit in place.

A preferred tray 10 is formed of a flexible material and is positioned on supporting means 11 within an outer carton 12 of any convenient type. Typically such cartons are formed from folded cardboard, or from wood or less frequently from hard plastics materials.

The supporting means 11 may comprise a series of legs attached to or moulded integrally with the material of the tray 10, or may consist of a separate matrix of supports 20 (see FIG. 5), e.g. formed from interlocking cardboard sheets, or the like, of the type generally used to separate bottles in a crate. Alternatively, the legs 11 could be attached to the base of the carton, and have upstanding pins which protrude through aperatures in the tray 10.

As shown in FIG. 2, it is preferred that the sheet 10 has a series of expansion folds 13 extending across the sheet and positioned along the lines of the recesses 14. Such a sheet 10 may be formed from thin food grade PVC sheet or from some other thin flexible sheet material, e.g. Tyvak.

Figure 4:
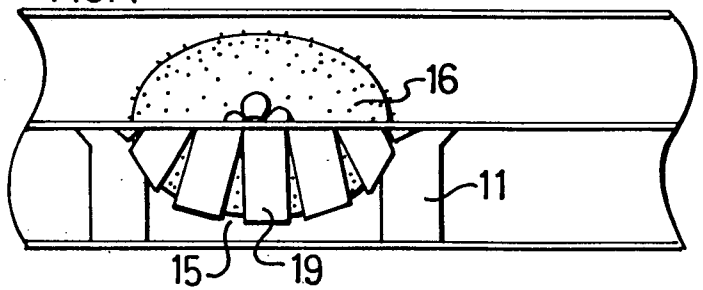
FIG. 4 illustrates a partly cut-away view along arrow B showing the kiwifruit of FIG. 3 positioned in the tray.
Figure 1:
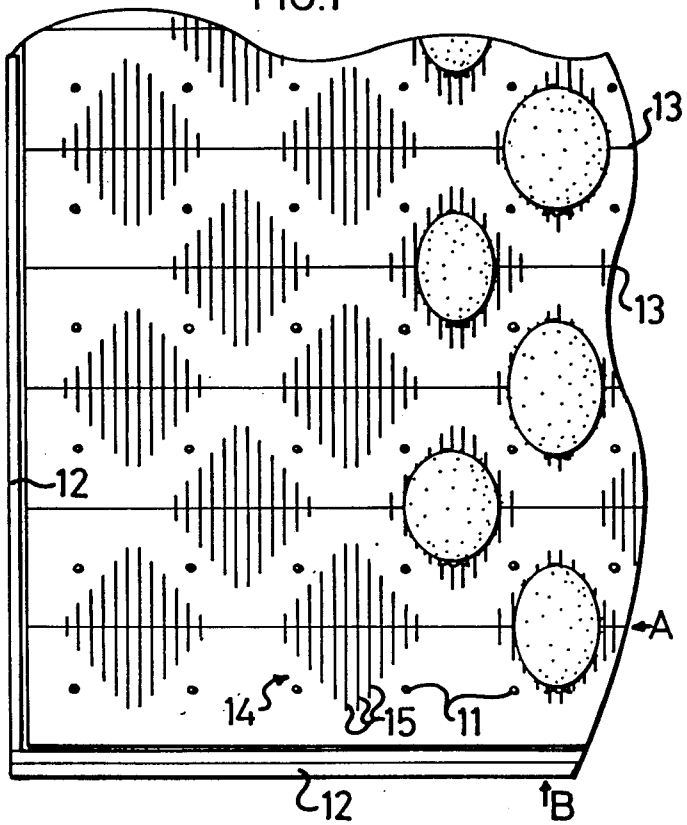
FIG. 1 illustrates a top plan view of a portion of a first preferred packaging tray within a carton.

Each recess 14 is defined by plurality of slits 15 transverse to the centre line of the expansion fold 13, as best seen in FIG. 1. These slits 15 preferably create a diamond pattern for use with elongate fruit such as kiwifruit. Of course, other slit patterns will be chosen for other fruit shapes These slits create a plurality of supporting strips in the zone of each recess, and normally appear flat when no fruit is present. However, when a fruit 16 is placed on the zone 14, the slits open and the supporting strips 19 bow downwardly and outwardly to create a hammock-like recess or pocket adapting itself to the size and shape of the fruit, as best seen in FIG. 4.

Preferably the two outer edges of the sheet 10, parallel to the folds 13, are folded downwardly as at 17 to provide extra material around the periphery of the tray.

It is preferred that expansion folds are provided in the sheet, although if a more resilient material is used, the expansion of the pockets may be created by the resilient nature of the strips rather than by the presence of expansion folds.

Figure 5:
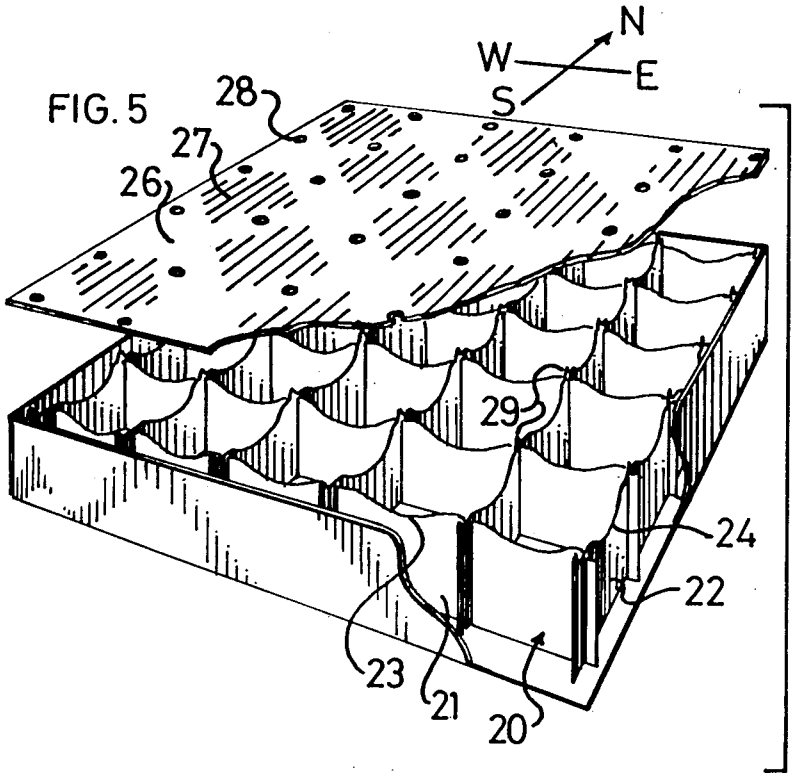
FIG. 5 illustrates an exploded partly cut-away perspective view of a modified tray using a separate matrix of supports.

FIG. 5 shows how more resilient materials may be used with a separate supporting matrix 20 formed from interlocking slats 21 and 22. In the following description the directions north-south, and east-west have been included to assist in explaining the matrix, but such directions are not intended to limit how the invention will be used. These slats can be conveniently formed by cutting and slitting cardboard or like material. For example, the east-west aligned slats 21 of FIG. 5 can have a series of slits extending from their top edges part way down their height, whilst the north-south aligned slats 22 could have complementary slits extending upwardly from their bottom edges so that the two sets of slats can have their slits interlocked to define a supporting matrix 20.

Preferably, the upper edges 23, 24 of the slats are contoured to accommodate the supporting layer 26. As the layer 26 is formed from a flexible and resilient material with north-south aligned slit patterns 27, and apertures 28, (but without the expansion folds of the tray of FIG. 1), it is desirable that this layer 26 be anchored on the matrix 20. To achieve this the slats 22 are provided with upstanding tabs 29 which engage the apertures 28 to support each resilient "hammock" portion 27. In use, the slits function to create the hammock-like recesses under the weight of the fruit with the slit portions stretching along the north-south direction as well as separating along the east-west direction. The north-south stretchability could be increased by cutting the strips in a zig-zag pattern to increase the available length of each strip portion.

The provision of these hammock-like pockets which conform to the size and shape of the fruit enable a packaging tray to accommodate a varying range of fruit while supporting each fruit snugly and separate from its neighbors, whilst at the same providing the appearance of a fruit substantially filling its pocket without any apparent "fruit shrinkage".

The packaging tray of this invention is particularly suited to kiwifruit, although it will be appreciated that it can be used to support other fruit or other items.

Finally, it will be appreciated that various alterations or modifications may be made to the foregoing without departing from the spirit or scope of this invention, as exemplified by the following claims.

We claim:

1. A packaging tray for supporting articles within recesses, for use in a carton having a base, comprising:

a supporting layer, supporting means associated with said supporting layer for spacing said supporting layer from said base of said carton, a plurality of flexible zones in said supporting layer, each comprising a plurality of parallel slits in said supporting layer, dividing said supporting layer within each flexible zone into a plurality of parallel strips, said flexible zones having ends and sides, said parallel slits extending from end to end of said flexible zones, said slits and said strips being progressively shorter toward the sides of said flexible zones, and elongation means associated with said strips permitting the length of said strips from end to end of said flexible zones to increase under the pressure supported articles.

2. A packaging tray as claimed in claim 1, wherein said elongation means comprises resilience in the material of said strips.

3. A packaging tray as claimed in claim 1, wherein said elongation means comprises at least two alternate folds in said strips, providing redundant length in said strips between said folds, such that by unfolding said folds, the length of said strips may be increased.

4. A fruit carton having a base and upstanding sides; a packaging tray, as claimed in claim 1, within the carton and supported above the base by said supporting means.

5. A fruit carton as claimed in claim 4, wherein the supporting means provides supports associated with each flexible zone.

6. A fruit carton as claimed in claim 5, wherein the supporting means comprises a cellular matrix having anchor points for the supporting layer.

* * * * *